United States Patent [19]

Shimizu

[11] 4,058,871

[45] Nov. 22, 1977

[54] HINGE ASSEMBLY FOR KNOCK DOWN FURNITURE

[76] Inventor: Takeshi Shimizu, 6-24-22, Kami-soshigaya, Setagaya, Tokyo, Japan

[21] Appl. No.: 634,733

[22] Filed: Nov. 24, 1975

[51] Int. Cl.[2] ..... F05D 1/06

[52] U.S. Cl. ..... 16/172

[58] Field of Search ..... 16/137, 128 R, 164, 16/165, 168, 169, 138, 140, 172

[56] References Cited

U.S. PATENT DOCUMENTS

| | | | |
|---|---|---|---|
| 3,890,671 | 6/1975 | Fantoni | 16/137 |
| 3,918,122 | 11/1975 | Gagner | 16/137 |

*Primary Examiner*—G. V. Larkin

*Attorney, Agent, or Firm*—Wenderoth, Lind & Ponack

[57] ABSTRACT

An assembly of components into a knock-down furniture structure is effected by using a plurality of mechanical coupling means so that each pair of abutting components are connected together in a surface abutting relationship. Each coupling means has its one unthreaded cylindrical portion residing in a complementary shaped hole obliquely provided in the abutting surface of one component and another unthreaded cylindrical portion residing in a complementary shaped hole obliquely provided in the abutting surface of another component.

3 Claims, 26 Drawing Figures

HINGE ASSEMBLY FOR KNOCK DOWN FURNITURE

BACKGROUND OF THE INVENTION

This invention relates to a method and a device for assembling plate-like components into a furniture which may be easily disassembled.

With a prior art technique, it is difficult to assemble and disassemble knock-down furnitures on side with ease and without threaded fittings.

Recently, particle boards have been broadly employed as panels for furnitures. Since particle board is made by heat forming wooden chips with synthetic resin binder under pressure, it has a good dimensional stability when in use. However, particle board has various disadvantage of, for example, a large specific gravity and a brittleness. Consequently, threaded fittings, such as screws, for attaching a metal joint (e.g., a hinge) between the panels of the furniture to be connected together can not be tightly held in the particle board.

Therefore, an assembling technique has been desired which requires no threaded fittings or only a minimum number of threaded fittings for assembling.

It is accordingly a principal object of the invention to provide a method and a device for assembling knock-down furnitures on site with ease and without threaded fittings or, at most with a minimum of threaded fittings.

With this object in view, the invention resides in a method of assembling the components into knock-down furniture by using a plurality of mechanical coupling means, whereby the abutting components are connected together in a surface abutting relationship, characterized in that each coupling means has one unthreaded cylindrical portion residing in a complementary shaped hole obliquely provided in the abutting surface of one component and a second unthreaded cylindrical portion residing in a complementary shaped hole obliquely provided in the abutting surface of another component.

The invention further provides a coupling device associated with at least two abutting components for connecting one component to another to assemble the components into knock-down furniture. The coupling device comprises a first unthreaded cylindrical portion disposed in the abutting surface of one component at an oblique angle relative thereto, and a second unthreaded cylindrical portion connected with the first portion at least when in use and disposed in the abutting surface of another component at an oblique angle relative thereto.

BRIEF DESCRIPTION OF THE DRAWINGS

The invention will become more readily apparent from the following description of preferred embodiments thereof shown, by way of example only, in the accompanying drawings wherein.

DESCRIPTION OF THE PREFERRED EMBODIMENTS

Figure 1:
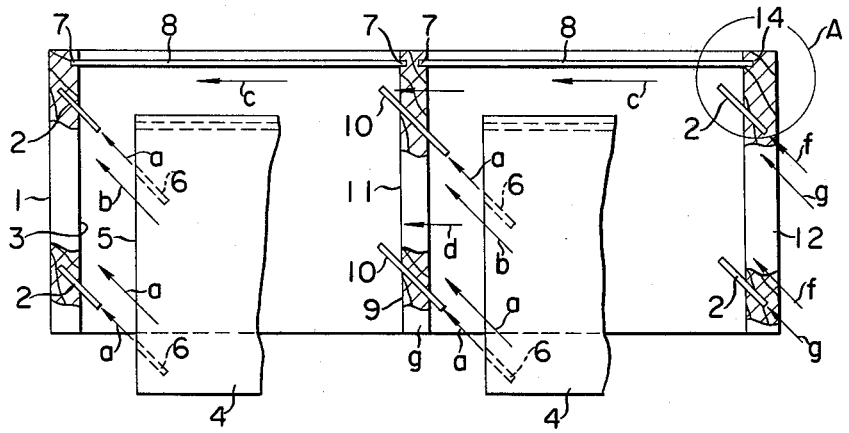
FIG. 1 is a plan view, partly in section, of a cabinet, illustrating the assembly procedure thereof according to the method of the invention.
Figure 2:
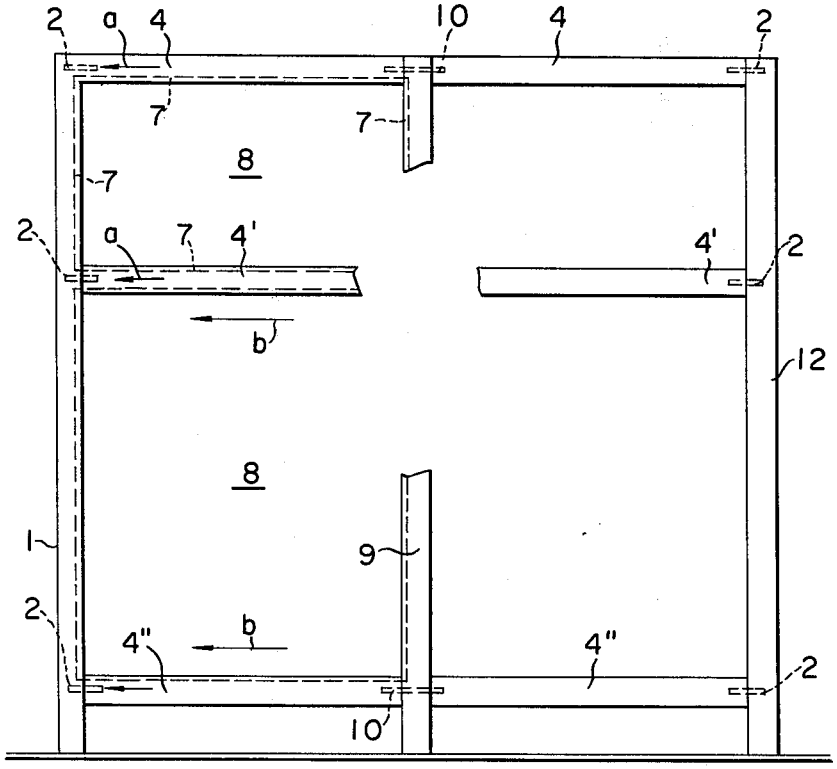
FIG. 2 is a front elevational view of FIG. 1.

Referring now to the drawings wherein like reference characters designate like or corresponding parts throughout the various views, there is shown in FIG. 1 an incomplete cabinet which has a lefthand side panel 1. Oblique tenons 2 each consisting of a cylindrical metal member are horizontally inserted into the side panel 1, as shown by an arrow *a*, at an angle of about 45 ° with respect to a mounting surface 3 of the side panel 1 until about half the length of the tenon 2 is inserted. The insertion angle of the tenon 2 is preferably about 45° and may be within about 30° - 60°. Although two tenons 2 are utilized for connection to the side panel 1, the number thereof is not of course limited thereto. A top panel 4 is formed with holes 6 complementary to the tenons 2 for receiving therein the remaining half length of the associated tenon. The top panel 4 with the holes 6 is horizontally moved in a direction *b* toward the tenons 2 to receive the latter in the associated holes 6 and its mounting surface 5 comes into contact with the surface 3. As shown in FIG. 2, an intermediate horizontal panel 4' and a bottom panel 4'' can also be fitted to the side panel 1 in the above manner. After the fitting of the panels 4, 4' and 4'' to the side panel 1, upper and lower rear panels 8 are inserted along a line *c* into channel-like grooves 7 provided in the edge portions of the panels 1, 4, 4' and 4''. In this embodiment, since all the tenons 2 are directed in the same direction *a*, when the panels 4, 4' or 4'' are moved in a direction opposite to the direction *a* before the insertion of the rear panels 8, the panel will become out of engagement with the tenons 2. However, after the fitting of the rear panels, the panel 4, 4' and 4" will be held against movement due to the engagement of the upper and lower rear panels 8 with the grooves 7, thus assuring the complete engagement.

Then, an intermediate upright panel 9 is moved in a direction *d* to have a groove 7, which is provided therein, fitted onto the edge portions of the rear panels 8. Separate oblique tenons 10, each of which is similar to the tenon 2 that the tenon 10 has about one and half times the length of the tenon 2, are horizontally inserted in a direction *e* through the intermediate upright panel 9 into the panel 4 at the aforementioned angel with respect to a contact surface 11 of the panel 9, thereby tightly securing the panel 9 in place. At this stage, the one-third length of each tenon 10 obliquely projects from a surface opposite to the surface 11 of the panel 9.

Figure 1A:
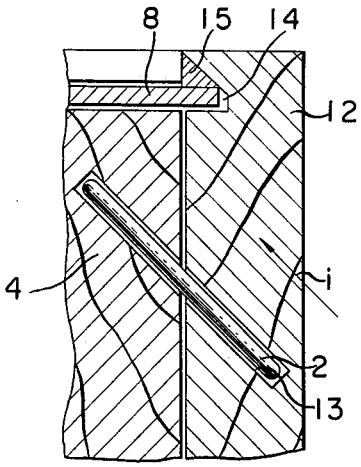
FIG. 1A is an enlarged view of a portion A shown in FIG. 1.

Then, separate righthand top, intermediate horizontal, bottom and rear panels are assembled with respect to the intermediate upright panel 9 in the same manner. After the oblique tenons 2 are inserted into the panels 4, 4' and 4" in a direction *f*, a righthand side panel 12 is moved in a direction *g* to receive the tenons 2 in holes 13 (see FIG. 1A) provided therein, Since the fitting of the righthand side panel 12 is effected by moving it obliquely, relative to the righthand upright edge of the rear panel a groove 14 is provided in the panel 12 for engagement with the rear panels 8 and has a shape shown in detail in FIG. 1A. That is, the groove 14 is of trapezoidal cross-section having a surface inclined at the same angle as the tenon. After the engagement of the side panel 12 with the rear panels, a space is provided in which a packing 15 is fixedly mounted to prevent the disengagement of the side panel 12 from the tenons 2 when the side panel 12 is moved in a direction opposite to the direction *g*.

Figure 3B:
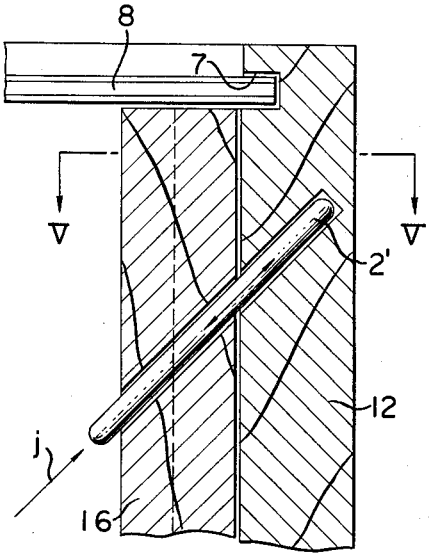
FIG. 3B is an enlarged view of a portion B shown in FIG. 3.
Figure 5:
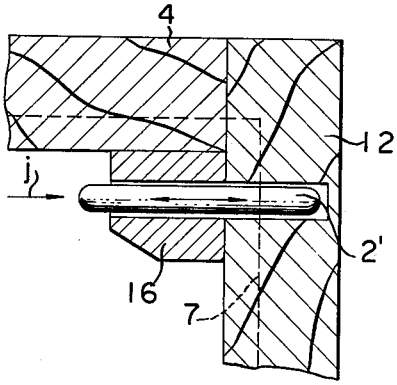
FIG. 5 is a sectional view of the portion B as viewed on the line V — V of FIG. 3B.
Figure 8:
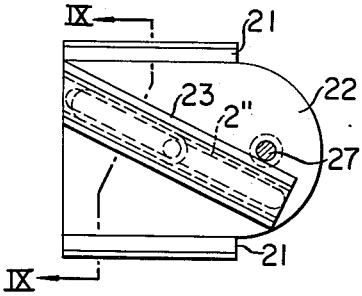
FIG. 8 is a plan view of the coupling device of FIG. 6.
Figure 3:
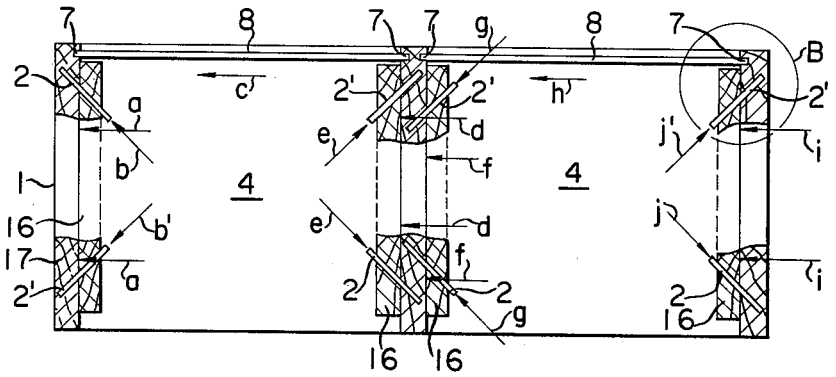
FIGS. 3 and 4 are views corresponding to FIGS. 1 and 2, respectively, showing another embodiment of the invention.
Figure 4:
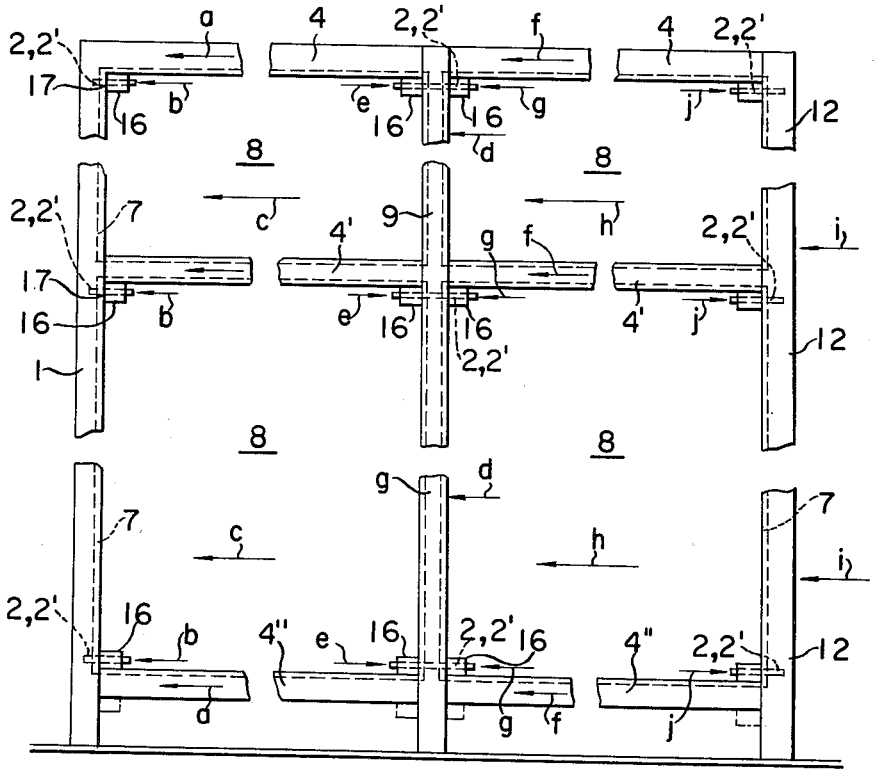
Figure 9:
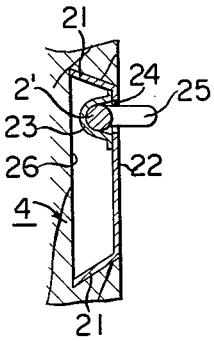
FIG. 9 is a view of the coupling device taken on the line IX — IX of FIG. 8.
Figure 10:
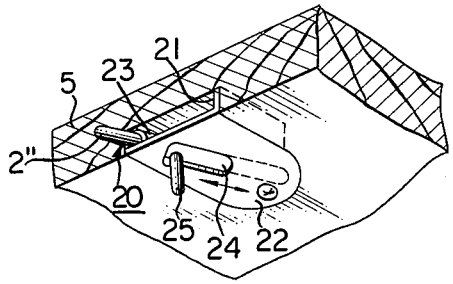
FIG. 10 is a perspective view of the coupling device shown in FIGS. 6 - 9.

The embodiment shown in FIGS. 3 and 4 is different from that of FIGS. 1 and 2 in that this embodiment utilizes oblique tenons 2' inserted in a reverse direction with respect to the tenon 2 and the tenons 2 and 2' are inserted through a support member 16, which is connected onto the lower surface of the respective top, intermediate horizontal or bottom panel 4, 4' or 4", into the side panel 1. The panels 4, 4' and 4" of this embodiment can be fixedly connected to the associated lefthand side, intermediate upright and righthand side panels 1, 9 and 12 merely by the insertion of the oblique tenons 2 and 2' and without help of the rear penels 8. When assembling the components into a cabinet, first, the panel 4 is moved in the direction *a* to be located in a position, in which an end surfce 17 of the support member 16 comes in contact with the side panel 1 and then the tenons 2 and 2' are inserted from the different directions through the support member 16 into the side panel 1 at the respective angles relative to the end surface 17 as best shown in FIG. 4. The subsequent assembling sequency is substantially the same as that described with respect to FIGS. 1 and 2, except that although in the embodiment of FIGS. 1 and 2 the long tenons 10 are utilized for the fitting of the intermediate longitudinal panel 9, with the embodiment shown in FIGS. 3 and 4, only the short tenons 2 and 2' are required. The assembling can be carried out in the order of arrows *a* to *j* shown in FIGS. 3 and 4. As in FIGS. 3A and 5, the fitting of the righthand side panel 12 is effected by inserting the tenons 2 and 2' in the directions *j* and *j'* through the support members 16 into the righthand side panel 12 after the side panel 12 is located in a position, in which it contacts the panels 4, 4' and 4" and the groove 7 provided therein receives the rear panel edges. This eliminates necessity of the packing member 15 utilized in the embodiment of FIGS. 1 and 2.

At this point, it is readily understood that, according to the assembling method of the present invention, the assembling and disassembling of a wall unit can be effected at a site without any threaded fittings and without the need for an assembler to go round to the back side of the wall unit. With the prior art technique, the assembling and disassembling has to be carried out away from the wall in a house, because the assembler is required to go round to the back side of the wall unit. Consequently, after the assembling or before the disassembling, the once assembled wall unit has to be moved toward or away from the wall. This is very troublesome especially in the case of a large-sized wall unit, and may cause severe damage to the coupling devices used in the wall unit. These disadvantages can be eliminated by the method of the present invention.

Although the assembling of the cabinet having one intermediate horizontal panel and one intermediate upright panel has been illustrated in conjunction with FIGS. 1 to 4, it is to be noted that the method according to the invention is applicable to assemblies of various cabinets, for example, a cabinet having two or more intermediate horizontal and/or upright panels, and a cabinet having a single intermediate horizontal or upright panel.

Figure 6:
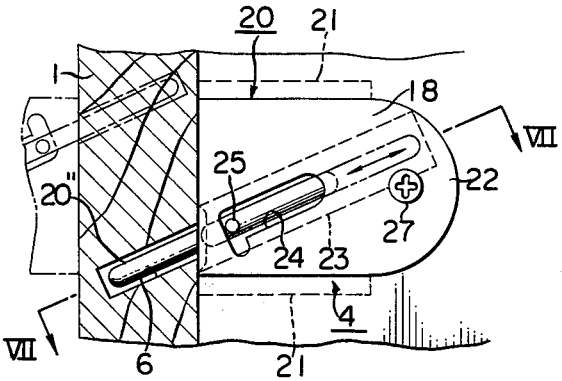
FIG. 6 is a view showing a coupling device according to the invention.
Figure 7:
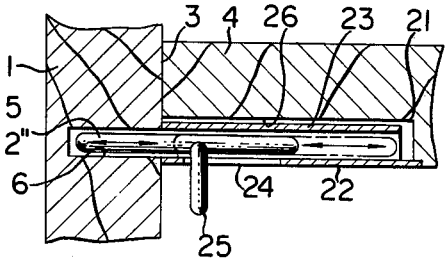
FIG. 7 is a view of the coupling device taken on the line VII — VII of FIG. 6.

FIGS. 6 to 10 show a different coupling device 20, which can eliminate the support member 16 used in the embodiment of FIGS. 3 and 4. The coupling device 20 comprises a plate member 18 and an oblique tenon 2". The plate member 18 has a pair of diverging legs 21 attached to a base plate 22, which is provided with a guide 23 along which the tenon 2" is obliquely slidable with respect to the legs 21. An elongated slot 24 is provided in the base plate to extend in the same direction as the tenon 2", and a protrusion 25 mounted on the tenon 2" extends through the slot 24 out of the guide 23. The coupling device 20 is inserted into a dovetail groove 26 provided in the top panel 4 until its end surface becomes flush with the end surface of the top panel 4 as shown in FIGS. 6 and 7. After the insertion, the coupling device 20 may be or may not be secured to the top panel 4 by means of a screw 27. In assembling, the top panel 4 is placed in end abutting relationship with the side panel 1 and thereafter the tenon 2" is inserted into the hole 6 by moving the protrusion 25 in the leftword direction along the guide 23 until it abutts against the end of the slot 24. In disassembling, the protrusion 25 is moved in the opposite direction.

The fittings of the not shown intermediate horizontal, bottom, intermediate upright, and righthand side panels can be accomplished substantially in the aforementioned manner.

It is preferable, but not essential, that the tenon 2" be inserted into the side panel 1 at an angle of about 45° with respect to the abutting surface thereof. Also, it is preferable to provide a coupling device having a tenon horizontally extending in the symmetrical direction with respect to the direction of the tenon 2" shown in FIGS. 6 to 10.

Figure 11:
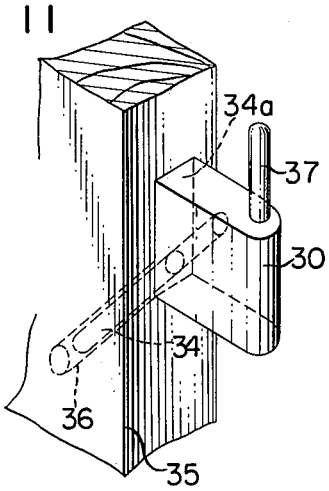
FIGS. 11 and 12 are perspective views of two coupling members composing a coupling device, which allows door panel to be attached for pivotal motion.
Figure 12:
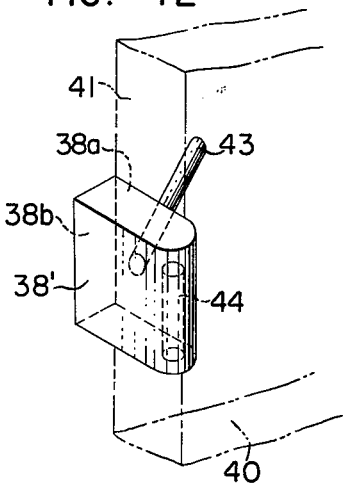
Figure 13:
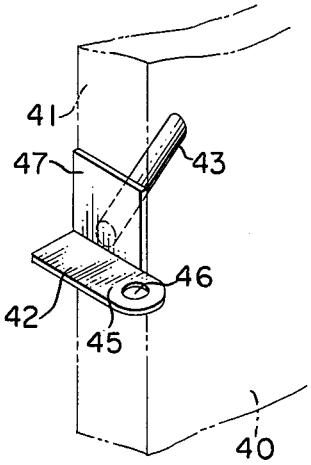
FIG. 13 is a view showing a modification of the coupling member of FIG. 12.

FIGS. 11 to 13 show different coupling elements with oblique tenons for securing a door panel to the cabinet.

The coupling element or door hinge element shown in FIG. 11 comprises a base block 30, an oblique tenon 34 extending downwards from an abutting surface 34*a* of the base block 30 at an angle of about 45° relative to the abutting surface 34*a*, and a support rod 37 extending upwardly from an upper surface of the block 30. The oblique tenon 34 is inserted into a complementary hole 36 provided in an upright panel 35 of the cabinet. On the other hand, a separate coupling element shown in FIG. 12 is attached to a door member 40. This coupling element comprises a base block 38', an oblique tenon 43 extending upwards from a surface 38*a* of the block 38' at an angle of about 45° relative thereto, and a vertical hole 44 provided in the block 38' as shown. The tenon 43 is inserted into a not shown complementary hole provided in a surface 41 of the door 40. When attaching the door 40 to the panel 35, it is merely necessary to move the door 40 so that the hole 44 provided in the base block 38' is fitted onto the support rod 37 mounted to the base block 30, whereby the door 40 is attached to the panel 35 for pivotal movement on the support rod 37. Since the block 38' turns in unison with the door 40, its surface 38*b* is preferably rounded to prevent interference between the panel 35 and the block 38'. In an embodiment shown in FIG. 13, an L-shaped base plate member 42 is employed instead of the base block 38'. The tenon 43 is mounted onto an upright portion 47 of the base plate 42 and an opening 46 corresponding to the hole 44 in the block 38' is provided in a horizontal portion 45 of the base plate 42. The setting of the door 41 with this coupling element can be effected in the same manner described above. Two or more coupling devices can be used for one door.

Figure 14:
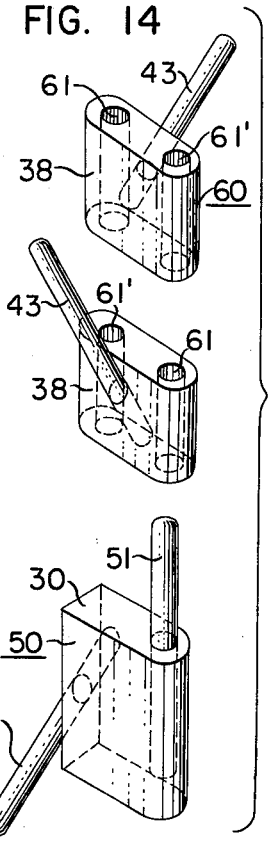
FIG. 14 is an exploded view of a coupling device of the invention, which allows two door panels to be attached for pivotal motion.
Figure 15:
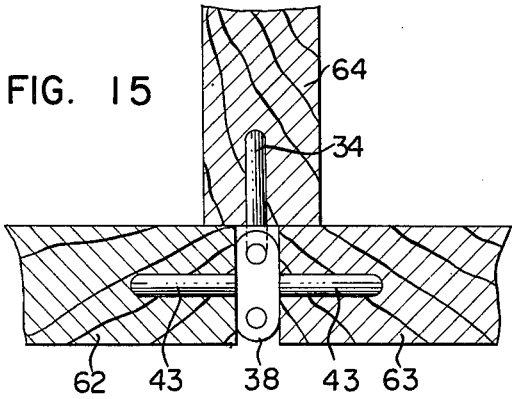
FIG. 15 is a fragmental view illustrating cabinet components connected for pivotal motion by the coupling device of FIG. 14.
Figure 17:
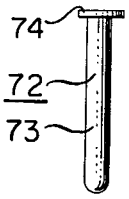
FIGS. 16, 17 and 18 are views of three modified coupling members composing a coupling device similar to that of FIG. 14.

FIGS. 14 and 15 show a modification of the coupling device shown in FIGS. 11 and 12. A coupling element 50 is similar to that of FIG. 11, except that a long support rod 51 is used to support two coupling elements 60 simultaneously and the coupling element 60 is similar to that shown in FIG. 12, except that two through holes 61 and 61' are provided in the block 38. This arrangement allows two doors 62 and 63 to be attached to an intermediate upright partition 64, as shown in FIG. 15, with a minimum number of parts. That is, the element 50 is attached to the partition 64 with the downwardly extending oblique tenon 43 inserting into a complementary hole provided in the partition 64. Then, the left-hand door 62 with the coupling element 60 is connected to the element 50 by fitting one hole 61 in the block 38 onto the support rod 51 and similarly the righthand door 63 with the coupling elements 60 is connected to the element 50 by fitting the other hole 61' in the block 38 onto the support rod 51. Thus, the doors 62 and 63 are connected with the partition 64 for pivotal motion on the rod 51.

Figure 18A:
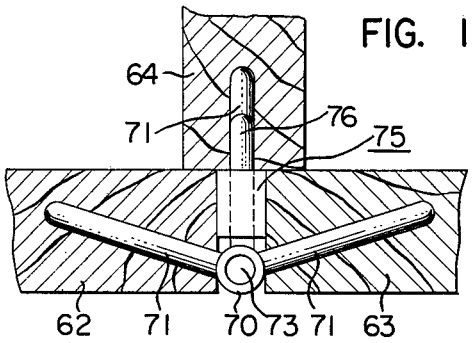
FIG. 18A is a view corresponding to FIG. 15.
Figure 16:
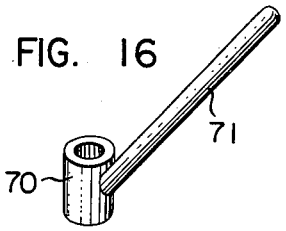
Figure 18:
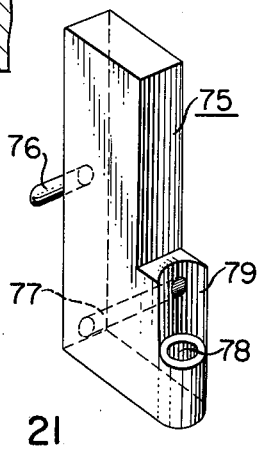

A further arrangement is disclosed in FIGS. 16 to 18, and 18A which also enables the two doors 62 and 63 to be attached to the partition 64. This arrangement comprises a fitting block 75, a tubular base member 70, an oblique tenon 71 fixedly secured to the base member 70, and a core pin 72 consisting of a shank 73 having a diameter slightly smaller than the inner diameter of the annular base member 70 and a circular head 74 having a diameter substantially equal to the outer diameter of the base member 70. The connection of the two doors 62 and 63 with the partition 64 can be effected by using the fitting block 75, three tubular base members 70 and one core pin 72. First, a downwardly oblique pin 76 fixed to the fitting block 75 is inserted as shown in FIG. 18A into a complementary hole provided in the partition 64. Then, the tenon 71 is inserted downwardly through an oblique hole 77 into a complementary hole provided in the partition 64 so that the first annular base member 70 is placed in a space 79. The second and third base members 70 are disposed on the first base member with one on the other so that the corresponding second and third tenons 71 are directed obliquely upwardly. Thereafter, the pin 72 is inserted through the three base members 70 into a blind hole 78 provided in the fitting block 75. Finally, the doors 62 and 63 are fitted onto the corresponding tenons 71, thus completing the connection of the doors 62 and 63 with the partition 64.

Of course, only two base members 70 can be used for the connection of the single door with the intermediate upright partition. The circular head 74 of the pin 72 may be omitted.

Figure 21:
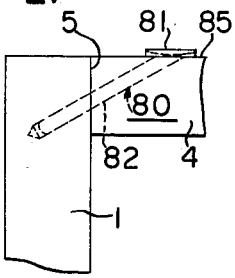
FIG. 21 is an enlarged view of a portion C shown in FIG. 20.
Figure 20:
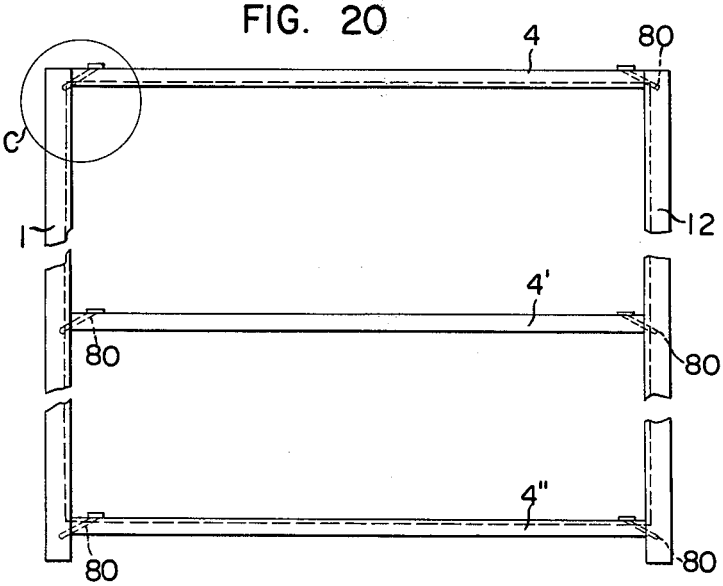
Figure 22:
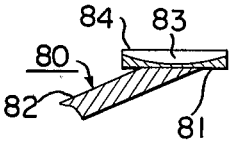
FIG. 22 is a fragmental sectional view of the coupling device shown in FIGS. 19 and 20.
Figure 23:
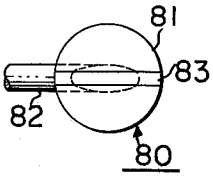
FIG. 23 is a plan view of FIG. 22.

FIGS. 19 to 23 show a still further modification of the invention, wherein a coupling device consisting of an oblique tenon 80 comprises a head or base portion 81 and a shank portion 82 extending from the base portion 81 at an angle of about 30° with respect to the base portion 81. The connection of the portions 81 and 82 can be made by welding, brazing or otherwise by suitable means. A groove 83 is provided in an upper surface 84 of the head portion 81 as shown in FIGS. 22 and 23.

Figure 19:
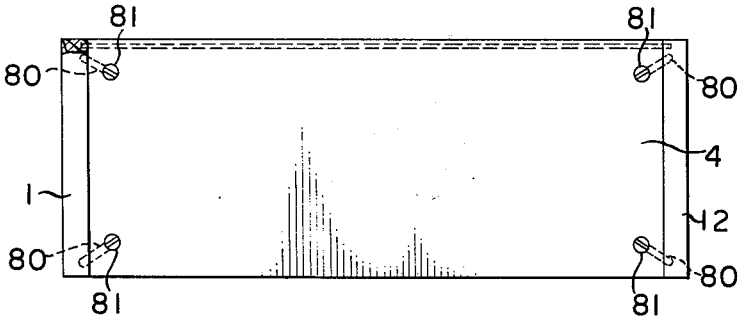
FIGS. 19 and 20 are views corresponding to FIGS. 1 and 2, but using a different type of coupling devices.

When the tenon 80 is fitted into both the top panel 4 and the side panel 1, the shank portion 82 makes an angle of about 30° with respect to the surface 85 of the top panel 4 as best shown in FIG. 21 and an angle of about 60° with respect to the abutting surfaces of the panels 1 and 4 as shown in FIG. 19. It is preferable that two tenons 80 on one end portion of the top panel 4 extend in the symmetrical directions. This assures that the panels are tightly secured to each other. Since the shank 82 attached to the panels is inclined with respect to the surface 85, when the head 81 is turned by a suitable tool inserted in the groove 83 provided therein, the shank 82 will rise to the surface 85 of the top panel 4 while turning with the head 81. This facilitates the removal of the tenon 80.

Although various specific embodiments have been described above, it will be readily understood by those skilled in the art that various rearrangements of parts and modifications of parts may be accomplished without departing from the spirit and scope of the invention as defined in the appended claims.

What I claim is:

1. A hinge for knock-down furniture, comprising:

at least two base blocks, at least one first base block associated with a stationary portion of said furniture and at least one second base block associated with a movable portion of said furniture;

hinge pin means between said base blocks for pivotally joining said base blocks;

at least one first tenon member obliquely extending from said first base block into said stationary furniture portion; and at least one second tenon member obliquely extending from said second base block into said movable furniture portion.

2. A hinge as claimed in claim 1, wherein:

said hinge pin means is integrally formed with said first base block and extends upward therefrom; and said second base block is positioned above said first base block and has an opening therein rotatably fitted around said hinge pin means.

3. A hinge as claimed in claim 1, wherein:

said first tenon member is angled obliquely away from and downward with respect to said first base block; and said second tenon member is angled obliquely away from and upward with respect to said second base block.

* * * * *